US007100339B2

(12) United States Patent
Hagel

(10) Patent No.: US 7,100,339 B2
(45) Date of Patent: Sep. 5, 2006

(54) GARAGE DOOR SYSTEM WITH INTEGRAL ENVIRONMENT RESISTANT MEMBERS

(75) Inventor: Richard C. Hagel, Nacogdoches, TX (US)

(73) Assignee: FrameSaver, LP, Nacogdoches, TX (US)

( * ) Notice: Subject to any disclaimer, the term of this patent is extended or adjusted under 35 U.S.C. 154(b) by 0 days.

(21) Appl. No.: 10/867,240

(22) Filed: Jun. 14, 2004

(65) Prior Publication Data

US 2004/0221523 A1 Nov. 11, 2004

Related U.S. Application Data

(63) Continuation of application No. 10/238,445, filed on Sep. 9, 2002, which is a continuation of application No. 09/621,590, filed on Jul. 21, 2000, now Pat. No. 6,446,410, which is a continuation of application No. 09/342,562, filed on Jun. 29, 1999, now Pat. No. 6,122,882, which is a continuation of application No. 09/130,160, filed on Aug. 6, 1998, now Pat. No. 5,950,391, which is a continuation of application No. 08/837,776, filed on Apr. 22, 1997, now Pat. No. 5,873,209, which is a continuation of application No. 08/612,757, filed on Mar. 8, 1996, now Pat. No. 5,661,943.

(51) Int. Cl.
*E04C 2/38* (2006.01)

(52) U.S. Cl. ..... 52/656.4; 52/211; 52/455; 52/458; 160/97; 160/201; 160/229.1

(58) Field of Classification Search ..... 52/455, 52/211, 213, 204.53, 458; 49/380, 225, 501; 160/97, 201, 229.1
See application file for complete search history.

(56) References Cited

U.S. PATENT DOCUMENTS 94,195 A 8/1869 Fisher
106,375 A 8/1870 Larkin (Continued)

FOREIGN PATENT DOCUMENTS

DE 808 280 7/1951

(Continued)

*Primary Examiner*—Carl D. Friedman
*Assistant Examiner*—Yvonne M. Horton
(74) *Attorney, Agent, or Firm*—Womble Carlyle Sandridge & Rice, PLLC

(57) ABSTRACT

The present invention is a garage door system having durable, yet cost effective characteristics. In one embodiment, a garage door system is comprised of a frame and a garage door. The frame comprises a top jamb and two side jambs. Each side jamb has upper- and lower-jamb portions in an end-to-end relationship. The upper-jamb portions are constructed from a first material and the lower-jamb portions include a durable material made from at least one material different from the first material. The garage door comprises an upper portion consisting of a first material and a lower portion secured to the upper portion wherein the lower portion includes a durable material made from at least one material different from the first material. Associated hardware may also be added.

14 Claims, 3 Drawing Sheets

U.S. PATENT DOCUMENTS

| | | | | |
|---|---|---|---|---|
| 114,138 | A | | 4/1871 | Hersey |
| 284,219 | A | | 9/1883 | Mehew |
| 505,156 | A | | 9/1893 | Camp |
| 574,641 | A | | 1/1897 | Streator |
| 575,035 | A | | 1/1897 | Marble |
| 685,186 | A | | 10/1901 | Snider |
| 772,928 | A | | 10/1904 | Dunlap |
| 844,726 | A | | 2/1907 | Hunter |
| 951,142 | A | | 3/1910 | Murray |
| 953,060 | A | | 3/1910 | Ross |
| 1,329,026 | A | | 1/1920 | Snyder |
| 1,489,170 | A | | 4/1924 | Stutz |
| 1,544,863 | A | | 7/1925 | Ross |
| 1,559,983 | A | | 11/1925 | Pfeiffer |
| 2,003,712 | A | | 6/1935 | Hacker |
| 2,281,864 | A | | 5/1942 | Toothacre |
| 2,292,301 | A | | 8/1942 | Smith |
| 2,292,806 | A | | 8/1942 | Toothacre |
| 2,334,113 | A | | 11/1943 | Malarkey |
| 2,591,768 | A | | 4/1952 | Austin |
| 2,781,559 | A | | 2/1957 | Savoie |
| 2,821,497 | A | | 1/1958 | Works et al. |
| 2,822,870 | A | | 2/1958 | Haynes |
| 2,824,342 | A | | 2/1958 | Hoyle, Jr. |
| 2,825,099 | A | | 3/1958 | Simmons |
| 2,854,843 | A | | 10/1958 | Lamb |
| 2,898,642 | A | | 8/1959 | Etling |
| 3,004,641 | A | | 10/1961 | Johnson |
| 3,082,490 | A | | 3/1963 | Loucks |
| 3,103,710 | A | | 9/1963 | Fredricksen |
| RE25,590 | E | | 6/1964 | Miller |
| 3,340,665 | A | | 9/1967 | Kohl |
| 3,345,780 | A | | 10/1967 | McGhee |
| 3,349,519 | A | | 10/1967 | Nehlig |
| 3,443,345 | A | | 5/1969 | Spencer |
| 3,480,054 | A | | 11/1969 | Marian |
| 3,538,642 | A | | 11/1970 | Fredricksen |
| 3,566,542 | A | | 3/1971 | Gillen et al. |
| 3,591,985 | A | | 7/1971 | Coppins |
| 3,676,966 | A | | 7/1972 | Ragland |
| 3,690,082 | A | | 9/1972 | Byland |
| 3,720,027 | A | | 3/1973 | Christensen |
| 3,746,776 | A | | 7/1973 | Monahan et al. |
| 3,769,773 | A | | 11/1973 | Mochizuki |
| 3,808,759 | A | | 5/1974 | Carmichael |
| 3,812,621 | A | | 5/1974 | Ragland |
| 3,878,647 | A | | 4/1975 | Bürgers |
| 3,911,548 | A | | 10/1975 | Perry |
| 4,007,569 | A | | 2/1977 | Hascall |
| 4,068,431 | A | | 1/1978 | Pitt |
| 4,068,433 | A | | 1/1978 | Glover |
| 4,096,677 | A | | 6/1978 | Gilb |
| 4,146,662 | A | | 3/1979 | Eggers et al. |
| 4,181,764 | A | | 1/1980 | Totten |
| 4,199,908 | A | | 4/1980 | Teeters |
| 4,237,664 | A | | 12/1980 | Wilmes |
| 4,281,480 | A | | 8/1981 | Wendt |
| 4,281,497 | A | | 8/1981 | Luotonen et al. |
| 4,306,821 | A | | 12/1981 | Moore |
| 4,378,043 | A | * | 3/1983 | Sorenson ..... 160/97 |
| 4,386,482 | A | | 6/1983 | Quinif |
| 4,387,543 | A | | 6/1983 | Tschan et al. |
| 4,429,498 | A | | 2/1984 | Pitt |
| 4,492,496 | A | | 1/1985 | Arnold |
| 4,516,365 | A | | 5/1985 | Chapman |
| 4,543,757 | A | | 10/1985 | Cosgrove |
| 4,543,764 | A | | 10/1985 | Kozikowski |
| 4,566,831 | A | | 1/1986 | Groth |
| 4,614,070 | A | | 9/1986 | Idland |
| 4,631,866 | A | | 12/1986 | Otto et al. |
| 4,640,053 | A | | 2/1987 | Lew |
| 4,644,722 | A | | 2/1987 | Phillips |
| 4,646,489 | A | | 3/1987 | Feller et al. |
| 4,702,057 | A | | 10/1987 | Phillips |
| 4,752,517 | A | | 6/1988 | Beitel |
| 4,779,389 | A | | 10/1988 | Landers |
| 4,783,945 | A | | 11/1988 | Heeg |
| 4,791,771 | A | | 12/1988 | Haugaard et al. |
| 4,793,109 | A | | 12/1988 | Noach |
| 4,828,004 | A | * | 5/1989 | Martinez ..... 160/229.1 |
| 4,866,901 | A | | 9/1989 | Sanchez |
| 4,870,797 | A | | 10/1989 | Hagemeyer |
| 4,892,601 | A | | 1/1990 | Norwood |
| 4,920,718 | A | | 5/1990 | Artwick et al. |
| 4,924,648 | A | | 5/1990 | Gilb et al. |
| 4,976,066 | A | | 12/1990 | Plummer et al. |
| 4,977,722 | A | | 12/1990 | Taylor |
| 4,982,530 | A | | 1/1991 | Palmer |
| 4,991,369 | A | | 2/1991 | Lamb |
| 4,995,206 | A | | 2/1991 | Colonias et al. |
| 4,999,950 | A | | 3/1991 | Beske et al. |
| 5,007,189 | A | | 4/1991 | Buckwalter |
| 5,014,471 | A | | 5/1991 | Ballstadt |
| 5,020,292 | A | | 6/1991 | Strom et al. |
| 5,022,134 | A | | 6/1991 | George |
| 5,022,206 | A | | 6/1991 | Schield et al. |
| 5,034,085 | A | | 7/1991 | Brauchl |
| 5,067,289 | A | | 11/1991 | Ouderkirk et al. |
| 5,074,087 | A | | 12/1991 | Green |
| 5,074,092 | A | | 12/1991 | Norlander |
| 5,086,601 | A | | 2/1992 | Galowitz et al. |
| 5,136,814 | A | | 8/1992 | Headrick |
| 5,148,649 | A | | 9/1992 | Cipriano |
| 5,161,329 | A | | 11/1992 | Brown |
| 5,175,973 | A | | 1/1993 | Owen et al. |
| D333,353 | S | | 2/1993 | Guhl et al. |
| 5,182,880 | A | | 2/1993 | Berge, Jr. et al. |
| 5,195,291 | A | | 3/1993 | Pomento |
| 5,199,234 | A | | 4/1993 | Guhl |
| 5,203,130 | A | | 4/1993 | Freelove |
| 5,203,817 | A | | 4/1993 | Klumpjan |
| 5,205,102 | A | | 4/1993 | Plummer |
| 5,210,986 | A | | 5/1993 | Hagemeyer et al. |
| 5,218,793 | A | | 6/1993 | Ball |
| 5,219,634 | A | | 6/1993 | Aufderhaar |
| 5,228,249 | A | | 7/1993 | Campbell |
| 5,249,399 | A | | 10/1993 | Aulson |
| 5,299,396 | A | | 4/1994 | Raap et al. |
| 5,315,796 | A | | 5/1994 | Gruhlke |
| 5,317,853 | A | | 6/1994 | Lopes |
| 5,337,469 | A | | 8/1994 | Richey |
| 5,339,588 | A | | 8/1994 | Ballstadt |
| 5,355,644 | A | | 10/1994 | Guhl et al. |
| 5,361,552 | A | | 11/1994 | Fulford |
| 5,365,708 | A | | 11/1994 | Winston |
| 5,380,131 | A | | 1/1995 | Crawford |
| 5,390,455 | A | | 2/1995 | Antolini |
| 5,394,649 | A | | 3/1995 | Lindgren et al. |
| 5,406,768 | A | | 4/1995 | Giuseppe et al. |
| 5,408,795 | A | | 4/1995 | Eijadi et al. |
| 5,412,909 | A | | 5/1995 | Wu |
| 5,426,894 | A | | 6/1995 | Headrick |
| 5,437,130 | A | | 8/1995 | Raynak |
| 5,438,812 | A | | 8/1995 | Erickson |
| 5,439,749 | A | | 8/1995 | Klasell et al. |
| 5,441,801 | A | | 8/1995 | Deaner et al. |
| D364,469 | S | | 11/1995 | Eijadi et al. |
| 5,465,540 | A | | 11/1995 | Biernazki |
| 5,467,564 | A | | 11/1995 | DeKeyser et al. |
| 5,475,960 | A | | 12/1995 | Lindal |
| 5,486,553 | A | | 1/1996 | Deaner et al. |
| 5,491,940 | A | | 2/1996 | Bruchu |
| 5,491,951 | A | | 2/1996 | Riegelman |
| 5,497,594 | A | | 3/1996 | Giuseppe et al. |

| | | | | |
|---|---|---|---|---|
| 5,501,054 | A | 3/1996 | Soltis et al. | |
| 5,516,236 | A | 5/1996 | Williams et al. | |
| 5,524,408 | A | 6/1996 | Richey | |
| 5,539,027 | A | 7/1996 | Deaner et al. | |
| 5,546,715 | A | 8/1996 | Edstrom | |
| 5,547,726 | A | 8/1996 | Dingler | |
| RE35,322 | E | 9/1996 | Owen et al. | |
| 5,553,420 | A | 9/1996 | Klimek | |
| 5,553,438 | A | 9/1996 | Hsu | |
| 5,560,164 | A | 10/1996 | Ahrens | |
| 5,573,354 | A | 11/1996 | Koch | |
| 5,575,115 | A | 11/1996 | Lindgren et al. | |
| 5,575,124 | A | 11/1996 | Novello, Jr. | |
| 5,584,154 | A | 12/1996 | Koepke et al. | |
| 5,598,667 | A * | 2/1997 | Dykes | 52/71 |
| 5,611,382 | A * | 3/1997 | Sferra | 160/113 |
| 5,634,303 | A | 6/1997 | Ellingson | |
| 5,649,397 | A | 7/1997 | Sauder | |
| 5,651,222 | A | 7/1997 | Bridges et al. | |
| 5,653,074 | A | 8/1997 | Yoon | |
| 5,661,943 | A | 9/1997 | Hagel | |
| 5,666,781 | A | 9/1997 | Egawa et al. | |
| 5,669,192 | A | 9/1997 | Opdyke et al. | |
| 5,775,041 | A * | 7/1998 | Tull et al. | 52/455 |
| 5,791,103 | A | 8/1998 | Coolman et al. | |
| 5,813,800 | A | 9/1998 | Doleshal | |
| 5,829,218 | A | 11/1998 | Murray et al. | |
| 5,829,920 | A | 11/1998 | Christenson | |
| 5,836,118 | A | 11/1998 | Thornton et al. | |
| 5,873,209 | A | 2/1999 | Hagel | |
| 5,904,199 | A * | 5/1999 | Messner | 160/219 |
| 5,950,391 | A | 9/1999 | Hagel | |
| 5,996,674 | A * | 12/1999 | Gatewood | 160/348 |
| 6,092,580 | A * | 7/2000 | Lucas | 160/113 |
| 6,098,351 | A | 8/2000 | Mills | |
| 6,122,882 | A | 9/2000 | Hagel | |
| 6,161,343 | A | 12/2000 | Young | |
| 6,185,894 | B1 * | 2/2001 | Sisco et al. | 52/457 |
| 6,216,411 | B1 * | 4/2001 | Barnett | 52/656.4 |
| 6,253,527 | B1 | 7/2001 | De Zen | |
| D447,574 | S | 9/2001 | Fening | |
| D448,089 | S | 9/2001 | Fening | |
| 6,295,779 | B1 | 10/2001 | Canfield | |
| 6,343,448 | B1 | 2/2002 | Lin | |
| 6,357,197 | B1 | 3/2002 | Serino et al. | |
| 6,415,844 | B1 * | 7/2002 | Smith | 160/216 |
| 6,425,222 | B1 | 7/2002 | Hagel | |
| 6,446,410 | B1 | 9/2002 | Hagel | |
| D465,579 | S | 11/2002 | Fening | |
| 6,481,179 | B1 | 11/2002 | Zen | |
| 6,604,334 | B1 | 8/2003 | Rochman | |
| 6,694,696 | B1 | 2/2004 | Hagel | |
| 2003/0005652 | A1 | 1/2003 | Hagel | |
| 2003/0070769 | A1 * | 4/2003 | Lampers | 160/113 |
| 2004/0206033 | A1 | 10/2004 | Hagel | |
| 2004/0221523 | A1 * | 11/2004 | Hagel | 52/204.1 |

FOREIGN PATENT DOCUMENTS

| | | | |
|---|---|---|---|
| DE | 1121309 | | 2/1960 |
| DE | 4002830 | A1 | 9/1990 |
| EP | 0466292 | A1 | 7/1991 |
| EP | 0550089 | A1 | 12/1992 |
| EP | 93306844.7 | | 8/1993 |
| EP | 1 007 816 | B1 | 9/2005 |
| FR | 2617087 | | 6/1987 |
| FR | 2 617 081 | | 12/1988 |
| FR | 2652298 | | 3/1991 |
| GB | 2112437 | * | 11/1982 |
| JP | SHO-50-132102 | A | 10/1975 |
| JP | SHO-52-108270 | U | 8/1977 |
| JP | S61-90978 | | 6/1986 |
| JP | H04-174186 | | 6/1992 |
| JP | 06088418 | | 3/1994 |
| JP | H07-91142 | | 4/1995 |
| NL | 8802254 | | 9/1988 |
| NL | 8900224 | | 8/1990 |
| NL | 9102135 | | 7/1993 |
| NL | 1002780 | | 10/1997 |
| WO | WO 98/11464 | | 3/1998 |

* cited by examiner

GARAGE DOOR SYSTEM WITH INTEGRAL ENVIRONMENT RESISTANT MEMBERS

This application is a continuation of U.S. patent application Ser. No. 10/238,445, filed Sep. 9, 2002, which is a continuation of U.S. patent application Ser. No. 09/621,590, filed Jul. 21, 2000, now U.S. Pat. No. 6,446,410, which is a continuation of Ser. No. 09/342,562, filed Jun. 29, 1999, now U.S. Pat. No. 6,122,882, which is a continuation of Ser. No. 09/130,160, filed Aug. 6, 1998, now U.S. Pat. No. 5,950,391, which is a continuation of Ser. No. 08/837,776 filed Apr. 22, 1997, now U.S. Pat. No. 5,873,209, which is a continuation of U.S. patent application Ser. No. 08/612,757, filed Mar. 8, 1996, now U.S. Pat. No. 5,661,943 issued Sep. 2, 1997. The substance and teachings of each of the aforementioned patents is incorporated herein by reference.

FIELD OF THE INVENTION

The invention relates to frames such as door or window frames, or other components such as porch posts, brickmolds, and casings, and particularly to components having integrally joined portions resistive to moisture, decay and insects.

BACKGROUND OF THE INVENTION

The construction industry is under constant pressure to provide quality products at low cost. Door frames and other construction components are no exception.

During construction of a home or the like, an opening is left in the wall in which the door or window is installed. In some cases, a custom door frame is built in the door opening. After the door frame is built, the door is hung within the door frame. While this provides builders complete control, such a construction technique can be time consuming and costly. Measurements and construction must be very precise to accurately place the door frame into the opening and account for small variations in the door.

Another method of hanging frames is with the use of pre-hung doors or windows. In this case, a completed frame and door is provided to the builder. An example of an adjustable door frame assembly is found in U.S. Pat. No. 3,812,621. Thus, the frame and door are pre-matched for tighter fitting door or windows.

One known method of providing pre-built frames at a low cost is with the use of scrap lumber. Scrap lumber is produced when a defect, such as a knot hole or imperfect edge, is removed from a larger or parent piece of lumber. This allows the parent lumber to be sold as a higher quality piece than it otherwise would. The resulting scrap piece containing the defect is typically much smaller than its parent piece. The scrap lumber is then processed or recycled by removing the defect to produce a relatively small, but still good quality piece of wood fiber. These small pieces are then finger jointed at their ends and joined end to end to produce a single long piece, which is used to produce the door frame.

Norlander in U.S. Pat. No. 5,074,092 describes a technique for overcoming certain deficiencies with inexpensive lumber having a variety of knots and other defects. Quality veneers are assembled with cores of short end-to-end staves of solid lumber to produce a laminated wood door product having stability and good appearance.

While these techniques have produced low cost door and window frames, the use of wood in them causes the frames to be susceptible to moisture and insects. In the past, once water or termite damage has caused a portion of the frame to decay, that portion of the frame was replaced. Repair was performed while the frame was in place. A craftsman would cut out the decayed portion and replace it with another wood or plastic section. Thus, while costs were initially low, the end result was often expensive.

SUMMARY OF THE INVENTION

The present invention is a garage door system having durable, yet cost effective characteristics not found in the prior art. In one embodiment, a garage door system is comprised of a frame and a garage door. The frame comprises a top jamb and two side jambs. Each side jamb has upper- and lower-jamb portions in an end-to-end relationship. The upper-jamb portions are constructed from a first material and the lower-jamb portions include a durable material made from at least one material different from the first material. The garage door comprises an upper portion consisting of a first material and a lower portion secured to the upper portion wherein the lower portion includes a durable material made from at least one material different from the first material. Associated hardware may also be added.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1:
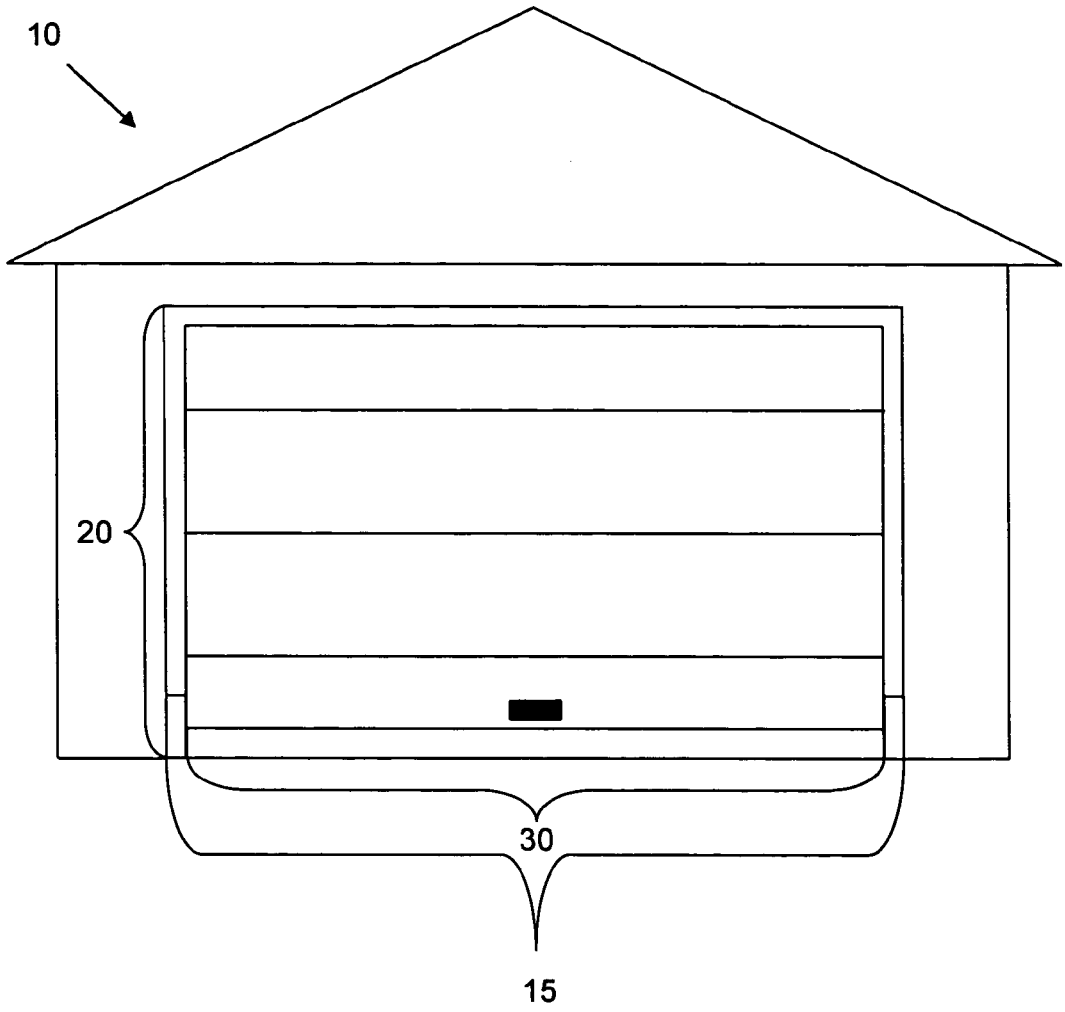
FIG. 1 depicts a garage comprising one embodiment of a garage door system of the present invention.

Referring now to FIG. 1, there is illustrated a building 10 comprising a garage door system 15 embodying the principles of the present invention. The garage door system 15 is comprised of a garage door frame 20 and a garage door 30.

Figure 2:
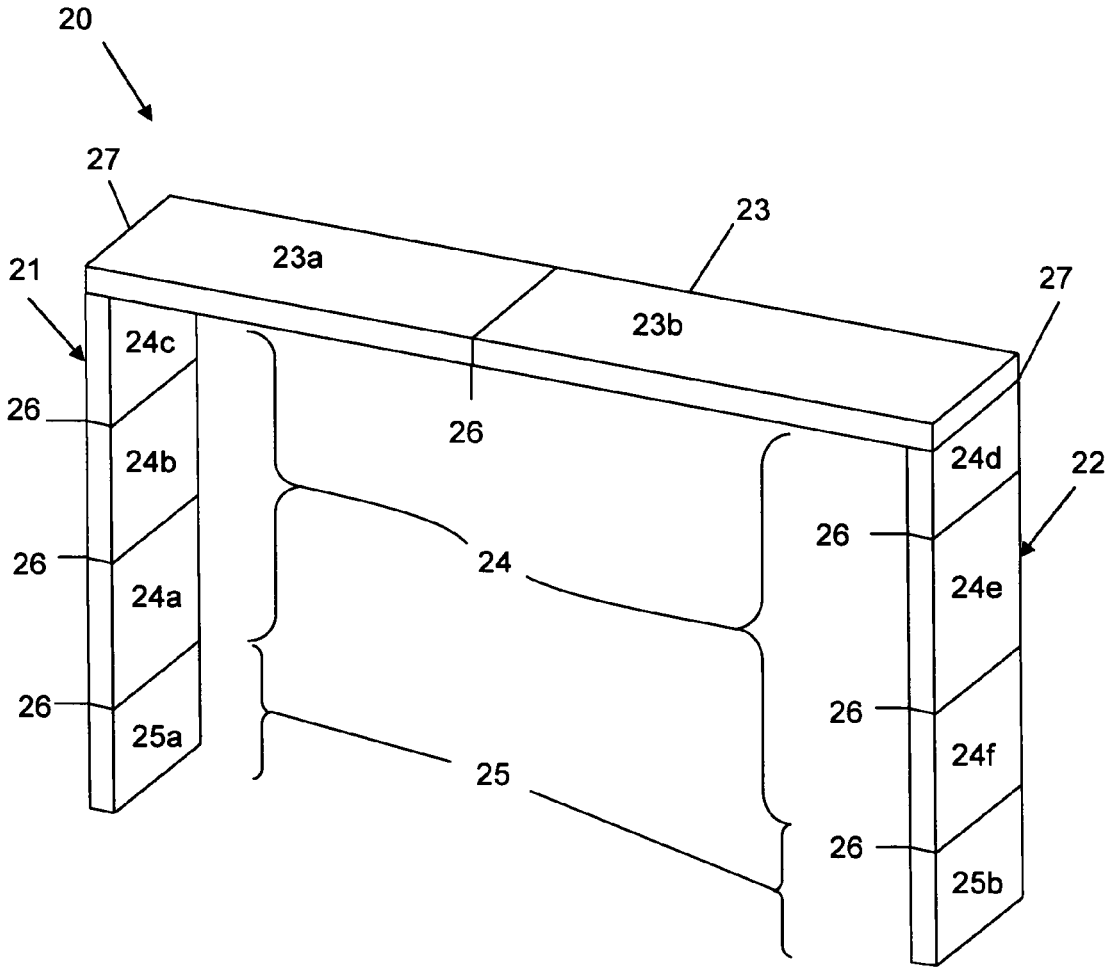
FIG. 2 illustrates a garage door frame in accordance with one embodiment of the present invention.

Referring now to FIG. 2, there is illustrated a garage door frame 20 embodying the principles of the present invention. Garage door frame 20 is comprised of spaced vertical side jambs 21 and 22 connected together at the top by a horizontal top jamb 23. Although not illustrated, it is to be understood that the vertical side jambs 21 and 22 and the horizontal top jamb 23 may have any suitable cross-section so as to accommodate a garage door. One conceivable cross-section is an L-shaped cross section, although other cross sectional shapes may be used.

Each of the vertical side jambs 21 and 22 are formed from an upper wood portion 24 and a lower durable portion 25. The wood portions 24 are formed from a number of smaller wood pieces 24*a*–24*f*. Side jamb 21 includes wood pieces 24*a*, 24*b* and 24*c* and side jamb 22 includes wood pieces 24*d*, 24*e*, and 24*f* (though there is no requirement that vertical side jambs 21 and 22 have the same number of wood pieces). The wood pieces 24*a*–24*f* are formed from what originally were pieces of scrap lumber which have been processed or recycled to remove imperfections, such as knots, bark or uneven surfaces. As shown, the wood pieces 24*a*–24*f* are not necessarily of even length and the side jambs 21 and 22 may comparatively include an unequal number or wood pieces. However, the number of pieces 24*a*–24*f* is not so many as to jeopardize overall strength of the frame 20.

Top jamb 23 is formed from a number of smaller wood pieces 23*a* and 23*b* in a manner similar to wood portion 24.

The durable portion 25 may be an extruded wood-based product, such as those wood-based products sold under any of the following trademarks—STRANDEX®, ERT®, TREX® or the like, which can be shaped using conventional wood processing techniques, painted or stained. The durable portion may also be made of plastic, vinyl, metal, and combinations of any of these materials. The durable portion 25 has the characteristics of being moisture, decay and insect resistant. Side jamb 21 includes a durable piece 25*a* and side jamb 22 includes a durable piece 25*b*. The placement of the durable portion 25 on the lower portion of the frame prevents all but the most severe weather and insect damage suffered by prior art door frames. The durable pieces 25*a* and 25*b* may be proportioned based on the expected exposure to adverse conditions such as rain, snow or insects. Thus, the assembly of the top jamb 23, the wood portion 24 and the durable portion 25 provides a durable, yet cost effective garage door frame. It is noted that other materials, such as plastic or similar extrusions, can be used for the durable pieces to achieve the principles of the present invention.

In the assembly of the side jambs 21 and 22, the durable pieces 25 are preferably connected end to end by a glued finger joint to the wood portions 24 (as disclosed in FIG. 2 of U.S. Pat. No. 5,661,943). It should be understood that other wood joints are contemplated, such as edge gluing or their equivalents. Alternatively, durable piece 25 may be connected to wood portion 24 with one or more mechanical fasteners such as screws, nails, dowels, brackets or other equivalent fasteners.

It should be further understood that the wood pieces comprising the wood portion 24 are also finger jointed so that the assembly of the wood portion 24 with the durable portion 25 forms a complete side jamb 21 or 22. Obviously, other wood joints are contemplated, such as edge gluing or their equivalents.

In the assembly of the garage door frame 20, the top jamb 23 is connected to the side jambs 21 and 22 with a corner joint 27. In use, the moisture, decay and insect resistant features of the garage door frame 20 prevent the problems associated with the prior art garage door frames.

Figure 3:
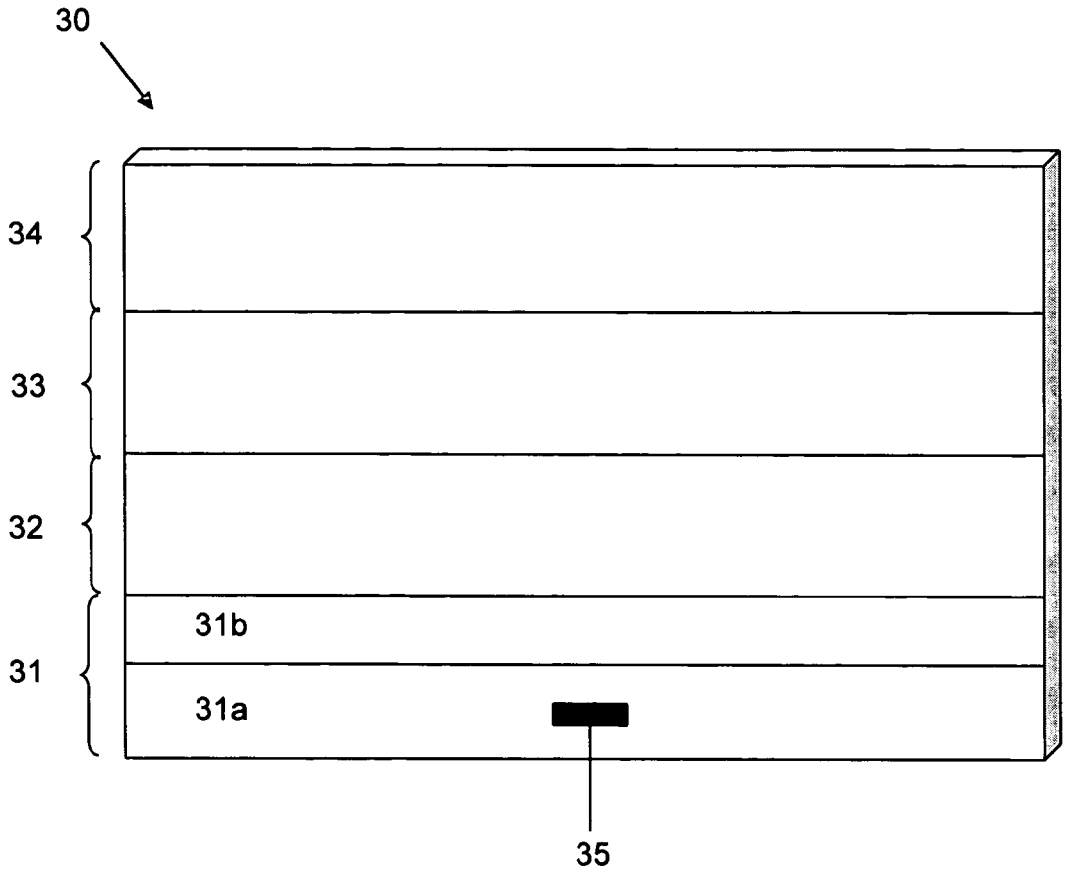
FIG. 3 illustrates a garage door in accordance with one embodiment of the present invention.

Referring now to FIG. 3, there is illustrated a garage door 30 embodying the principles of the present invention. Garage door 30 is comprised of a series of panels 31, 32, 33 and 34. An optional handle 35 is additionally illustrated. As shown, garage door 30 comprises 4 panels; however, the number of panels may be varied based on the design of the garage door. That is to say, the garage door may be a single panel (where the single panel comprises an upper wooden portion with a lower durable piece attached thereto) or comprise a plurality of panels (where the lowest panel comprises an upper wooden portion with a lower durable piece attached thereto or where the lowest panel is entirely constructed from the durable material).

As shown, garage door panel 31 includes a durable piece 31*a* and a wood portion 31*b*. In the assembly of the garage door 30, the durable piece 31*a* is preferably connected by a glued finger joint to the wood portion 31*b* (as disclosed in FIG. 2 of U.S. Pat. No. 5,661,943). It should be understood that other wood joints are contemplated, such as edge gluing or their equivalents. Alternatively, durable piece 31*a* may be connected to wood portion 31*b* with one or more mechanical fasteners such as screws, nails, dowels, brackets or other equivalent fasteners.

The durable portion 31*a* may be an extruded wood-based product, such as those wood-based products sold under any of the following trademarks—STRANDEX®, ERT®, TREX® or the like, which can be shaped using conventional wood processing techniques, painted or stained. The durable portion may also be made of plastic, vinyl, metal, and combinations of any of these materials. The durable portion 31*a* has the characteristics of being moisture, decay and insect resistant. The placement of the durable portion 31*a* on the lower portion of the lowest garage door panel prevents all but the most severe weather and insect damage suffered by prior art garage doors. The durable piece 31*a* may be proportioned based on the expected exposure to adverse conditions such as rain, snow or insects. Thus, the assembly of the top jamb 23, the wood portion 24 and the durable portion 25 provides a durable, yet cost effective garage door frame. It is noted that other materials, such as plastic or similar extrusions, can be used for the durable pieces to achieve the principles of the present invention.

It is noted that the use of the present invention is not limited to garage door systems. The invention may be used in window frames, door frames, porch posts, casings, brickmolds, doors and other applications where wood is heavily subjected to weather or insects, and a cost effective solution is desired. Further, it is noted that solid stock lumber can be used in place of pieces 24*a*–24*f* without detracting from the principles of the present invention. It is also noted that further weather and insect protection can be afforded by chemically treating the wood pieces, although at a somewhat higher cost.

In describing the invention, reference has been made to a preferred embodiment and illustrative advantages of the invention. However, those skilled in the art and familiar with the disclosure of the present invention may recognize additions, deletions, modifications, substitutions, equivalents and other changes may be made without departing from the spirit of the invention.

What is claimed is:

1. A garage door comprising:

at least two panels wherein one of said at least two panels is a bottom panel, said bottom panel comprising:

an upper portion consisting of wood; and a lower portion secured to said upper portion, said lower portion consisting of a blend of wood particles and thermoplastic material.

2. The garage door according to claim 1 wherein said lower portion is secured to said upper portion by a glued finger joint.

3. A building comprising at least one garage door in accordance with claim 1.

4. A garage door comprising:

a single panel comprising:

an upper portion consisting of wood; and a lower portion secured to said upper portion, said lower portion consisting of a durable wood having greater weathering characteristics than said wood forming said upper portion.

5. The garage door according to claim 4 wherein said lower portion is secured to said upper portion by a glued finger joint.

6. A building comprising at least one garage door in accordance with claim 4.

7. A garage door system comprising:

a frame defining a garage door opening, said frame comprising:

a top jamb; and two side lambs having upper- and lower-jamb portions in an end-to-end relationship, said upper-jamb portions being made of a first material, said lower-jamb portions including a durable material made from at least one material different from said first material; and a garage door disposed in said garage door opening, said garage door comprising:

at least one panel, wherein one of said at least one panel is a bottom panel, said bottom panel comprising:

an upper portion consisting of a first material; and a lower portion secured to said upper portion, said lower portion including a durable material made from at least one material different from said first material.

8. The garage door system in accordance with claim 7 wherein said durable material of said lower-jamb portion comprises a blend of wood particles and thermoplastic material.

9. The garage door system in accordance with claim 7 wherein said durable material of said lower portion of said garage door comprises a blend of wood particles and thermoplastic material.

10. The garage door system according to claim 7 wherein said lower portion is secured to said upper portion by a glued finger joint.

11. A building comprising at least one garage door system in accordance with claim 7.

12. A garage door system comprising:

a frame defining a garage door opening, said frame comprising:

a top jamb; and two side jambs having upper- and lower-jamb portions in an end-to-end relationship, said upper-jamb portions being made of a first material, said lower-jamb portions including a blend of wood particles and thermoplastic material; and a garage door disposed in said garage door opening, said garage door comprising:

at least one panel, wherein one of said at least one panel is a bottom panel, said bottom panel comprising:

an upper portion consisting of a first material; and a lower portion secured to said upper portion, said lower portion including a blend of wood particles and thermoplastic material.

13. The garage door system according to claim 12 wherein said lower portion is secured to said upper portion by a glued finger joint.

14. A building comprising at least one garage door system in accordance with claim 12.

* * * * *